United States Patent [19]

Jakobs

[11] 4,168,806

[45] Sep. 25, 1979

[54] ROLL TYPE CRUSHING MILL

[75] Inventor: Willy Jakobs, Cologne, Fed. Rep. of Germany

[73] Assignee: Klöckner-Humboldt-Deutz AG, Fed. Rep. of Germany

[21] Appl. No.: 874,695

[22] Filed: Feb. 2, 1978

[30] Foreign Application Priority Data

Feb. 2, 1977 [DE] Fed. Rep. of Germany ..... 2704243

[51] Int. Cl.[2] ..... B02C 4/32

[52] U.S. Cl. ..... 241/232; 241/234

[58] Field of Search ..... 241/227, 230–234

[56] References Cited

U.S. PATENT DOCUMENTS

| | | | |
|---|---|---|---|
| 727,177 | 5/1903 | Montgomery | 241/232 |
| 3,099,406 | 7/1963 | Kautz | 241/231 X |
| 3,208,678 | 9/1965 | Pick et al. | 241/232 X |
| 3,587,986 | 6/1971 | Alciati | 241/231 |
| 3,884,421 | 5/1975 | Fullalove et al. | 241/230 |
| 3,970,256 | 7/1976 | Ruegger et al. | 241/234 X |

FOREIGN PATENT DOCUMENTS 1221887 7/1966 Fed. Rep. of Germany .

*Primary Examiner*—Howard N. Goldberg

*Attorney, Agent, or Firm*—Hill, Van Santen, Steadman, Chiara & Simpson

[57] ABSTRACT

A roll crushing mill of the type having a frame with two rotatably disposed crushing rolls parallel and in opposition to one another forming therebetween a crusher gap are both deflectable relative to one another, each roll being mounted on a rotary shaft, each shaft being mounted on a carriage, and the carriages being swingably pivoted on the frame.

7 Claims, 4 Drawing Figures

ROLL TYPE CRUSHING MILL

This invention relates to a crushing or comminuting mill with a frame and with two crusher rolls positioned rotatably parallel to one another, which form between them a crusher gap.

Previously known crushing mills have a stationary or fixed position roll or an adjustable roll and a deflecting roll which upon exceeding of a maximally permissible pressure in the roll or crusher gap shifts to the side for the prevention of damage to the machine. Deflecting rolls are known which are biased by a mechanical or hydraulic spring and may carry out a translatory deflecting movement. It is also known that the deflecting roll may carry out an arcuate deflecting movement, in that it is mounted on a swingable rocker arm which is resiliently supported by means of a spindle on a support of the machine housing, (for example, German Laid Out Specification No. 1,221,887).

It will be examined as to what occurs in the case of the last mentioned type of crushing mill which is a so-called oscillating mill, when an overload occurs by reason of a non-comminutable foreign body getting into the crusher gap. By way of illustration, the weight of the two rolls of such a mill may be 1000 kg. each, and the spring tension holding the two rolls together may be 100 kg while the deflecting acceleration of the deflecting roll caused by means of the foreign body may be 10 times the acceleration due to gravity. The acceleration force of 1000 Kg.$\times$10=10,000 kg. plus 100 kg. true specific weight of the roll plus 100 kg. spring tension result in a total high load of 11,100 kg. which is fully imposed on the bearing of the stationary or fixed position roll. However as to the movable deflecting roll, the high acceleration force of 10,000 kg. occurring in the crusher gap is to the utmost dissipated by means of the 1000 kg. mass acceleration of the deflecting roll, the bearing of which roll is therefore loaded only with 1000 kg. true specific weight plus 100 kg. spring force which equals 1100 kg. Upon occurrence of an overload, accordingly, the bearing load upon the rolls is very different, and in the case of the stationary or fixed position roll very high. Further disadvantages of such an oscillating roll mill will become apparent from the advantages of the present invention as hereinafter described.

An important object of the present invention is to provide an improved crushing roll mill having deflectable rolls, with respect to many characteristics, particularly to attain a lower load distributed as symmetrically as possible of all roll bearings, increased output yield, and simplification of the adjustment of the roll or crushing gap.

In accordance with the invention, a crushing roll mill is provided in which both rolls are substantially equally deflectable deflecting rolls which in each case are carried by a rocker arm carriage which is swingably mounted on the machine frame.

By this invention, substantially the following advantages are attained as compared with a roll mill in which only one of the cooperating rolls is oscillatable: As both rolls deflect sideways upon occurence of overload, the deflecting paths, the accelerations of the deflecting movements and the acceleration forces resulting therefrom are halved. One may therefore in the case of the roll mill according to the present invention, permit of double the circumferential speed of the rolls and therewith a substantially higher output of crushed material compared with a roll mill with only one deflectable roll. High acceleration forces, which may act on the rolls in the crusher gap, are dissipated through the mass acceleration, that is, lifting and pressing apart of the two heavy deflecting rolls. The bearing load is comparably low even upon impact-type overloads, and it is distributed efficiently and substantially completely uniformly and symmetrically on all four of the roll bearings. The position of the crusher gap in spite of possible wear of both rolls remains unchanged, whereby relative shifting of the charging apparatus for the grinding material is eliminated. To the contrary, in the case of a roll mill with only one shiftable roll, a conforming adjustment of the charging apparatus toward the stationary roll is absolutely necessary, because otherwise the grinding material does not accurately encounter the rolls in the center of the crusher gap, but laterally close by, whereby the output yield is decreased.

According to one feature of the invention, both the main bearings of each of the two grinding rolls are mounted in a respective rocker carriage arm, and all four rocker arms are mounted swingably on pivot means in their lower portions on the machine frame. Both rotary shafts of the rolls may lie within and above the axes of rotation of the rocker arms but they may also lie outside of the axes of rotation of the rocker arms.

The rocker arms disposed opposite one another with respect to the crusher gap are connected at their upper portions by means of at least biasing means or one spring, particularly by means of pivotally connected hydraulic cylinders at both ends. The two rolls are accordingly mutually connected cooperatively by the hydraulic cylinders, whose length is so adjusted that the desired crusher gap remains substantially constant. As one cannot practically measure the width of the crusher gap during the operation of the roll mill, the force equivalent to the desired gap is measured, and maintained substantially constant by maintaining the oil pressure in the hydraulic cylinder substantially constant. To assure against overload, a pneumatic cushion is provided in the cylinders which is prestressed sufficiently higher with respect to the operating pressure, for example, operating pressure of 10 atmospheres, gas storage prestress 100 atmospheres. Accordingly, an automatic after adjustment of the rolls may easily be carried out. With this manner of operation, three conditions should be constant; the type, the grain distribution and the quantity of the grinding material should flow through the crusher gap; in the range of little output to output equal to zero, the automatic after adjustment of the rolls may be eliminated. With crusher gap maintained constant, the rolls should preferably be uniformly cylindrical, but out-of-round rolls will automatically become cylindrical again.

According to another feature of the invention, the rocker arms which oppose one another are coupled together by means of a coupling member so that they may exert a synchronous and symmetrical deflecting movement opposite to the plane of symmetry through the crusher gap, but not, however, a rectilinear or unidirectional movement. This stabilizes the rocker arms with the rollers mounted thereon against non-uniform displacement. To this end, the opposed rocker carriages may have opposed extensions articulated by means of links substantially aligned with the vertical plane extending through the crusher gap. Such articulation may also be effected by means of interengaging gear wheel segments.

According to still another feature of the invention, the axis of rotation of the rotary drives for the rolls, for example, belt-drives, lie approximately on the axis of the axes of rotation of the rotating shafts. Thereby, the radial spacing of the belt drives does not change, even if the carriage with the affected driven rolls, deflects sideways; and a consequent adjustment of the belts is therefore not required.

The invention will be explained in greater detail on the basis of the embodiment by way of example shown more or less schematically in the drawings.

Figure 3:
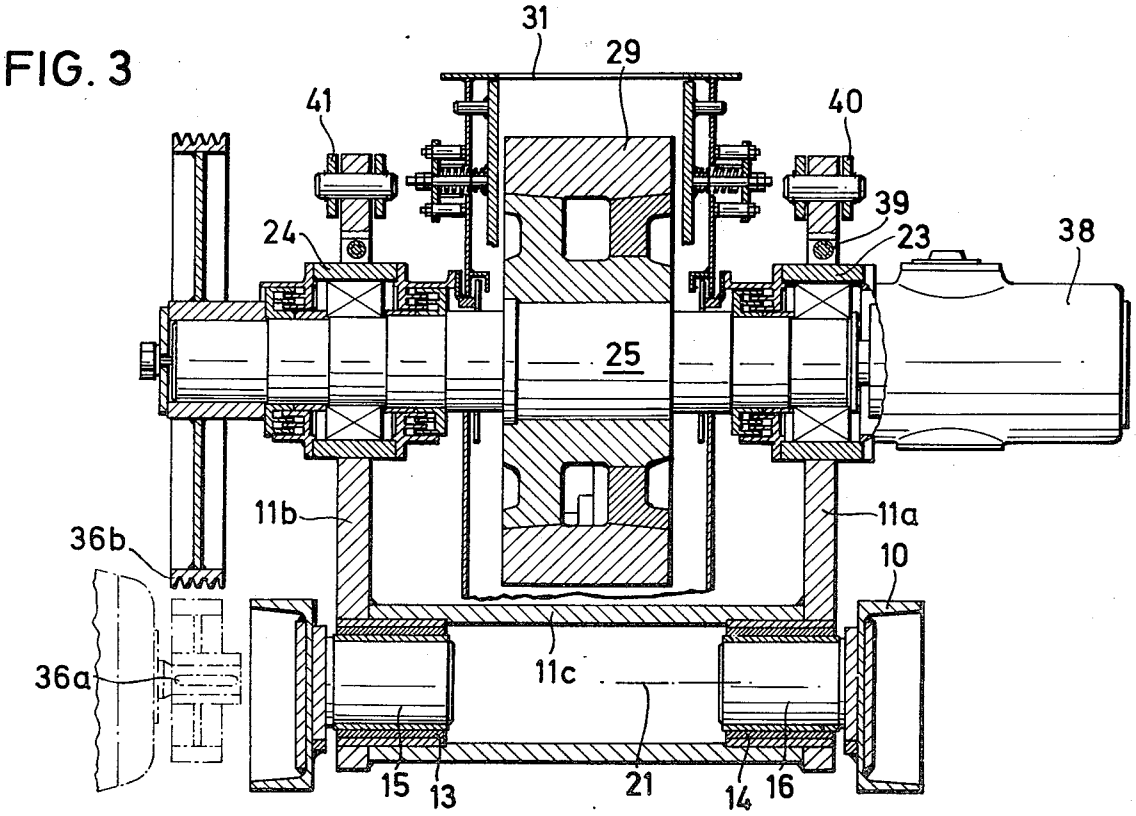
FIG. 3 shows a section along the line III—III of FIG. 1.
Figure 4:
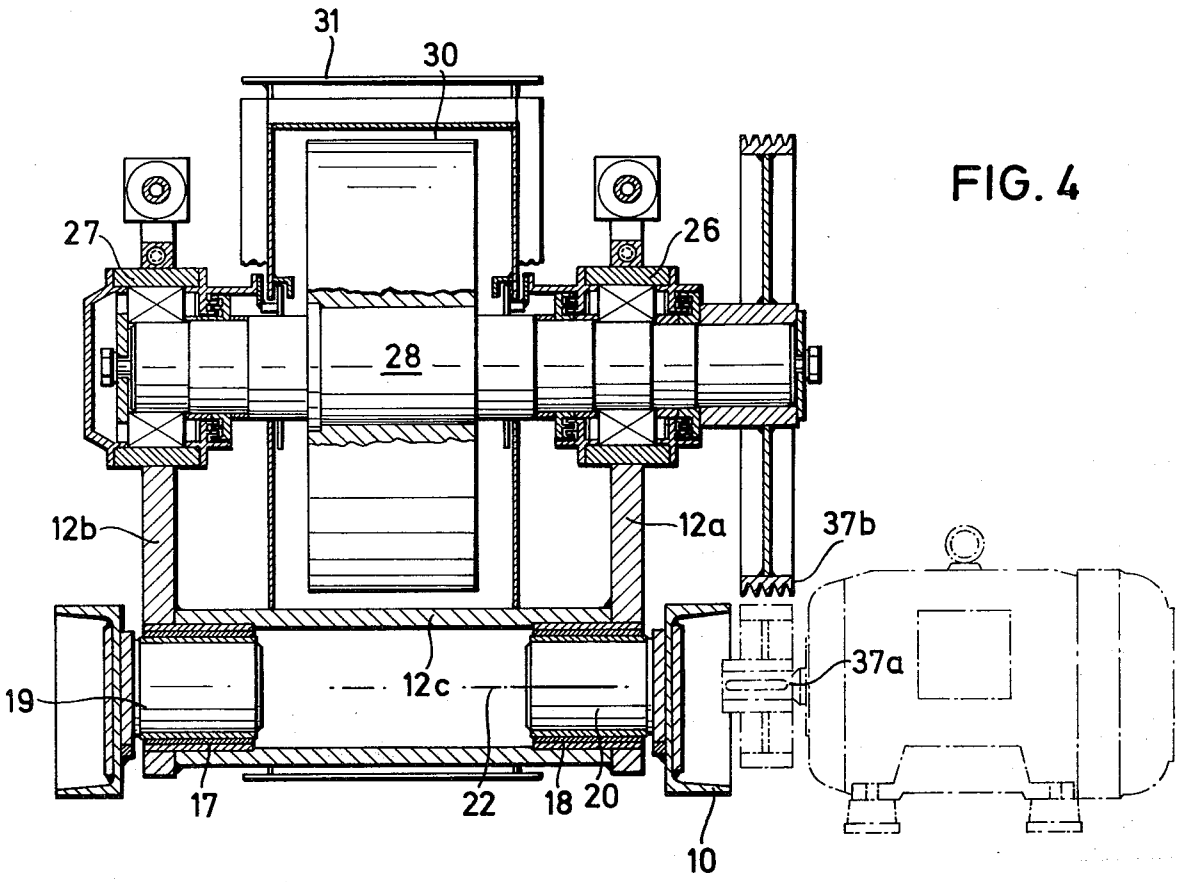
FIG. 4 shows a section along line IV—IV of FIG. 1.

A roll crusher mill according to the invention has a rectangular frame 10, on which are oscillatably mounted two rocker carriages 11 and 12. The carriage 11 has two upwardly extending rocker arms 11*a* and 11*b*, and the carriage 12 has two upwardly extending rocker arms 12*a* and 12*b*. The rocker arms 11*a* and 11*b* are rigidly connected to one another at their lower end portions by means of a member 11*c*, and the rocker arms 12*a* and 12*b* by means of a tubular member 12*c*. As seen in FIG. 3, the tubular member 11*c* is connected through rotary-elastic bushings 13 and 14 with coaxial, inwardly extending spaced stub shafts 15 and 16 on the frame 10. As seen in FIG. 4, the tubular member 12*c* is connected through rotary-elastic bushings 17 and 18 with coaxial, inwardly extending spaced stub shafts 19 and 20 on the frame 10. In this manner, the carriages 11 and 12 are permitted to swing to a certain degree about their respective axes of rotation 21 and 22. In the upper portions of the rocker arms 11*a* and 11*b* are mounted bearing blocks 23 and 24 journalling a roll shaft 25, while in upper portions of the rocker arms 12*a* and 12*b* are mounted bearing blocks 26 and 27 for journalling a roll shaft 28. On the shaft 25 is fixedly mounted a roll 29, and on the shaft 28 a roll 30. Both axes of rotation of the rolls lie within (inwardly relative to) and above the axes of rotation 21 and 22 of the rotating shafts. The rolls 29 and 30 form between them a crusher gap, in which the material to be ground, which is to be supplied through a stationary, central rectangular cross-section charging apparatus 31, is comminuted. The comminuted material passes downwardly through an opening 32 out of the roll mill.

Figure 1:
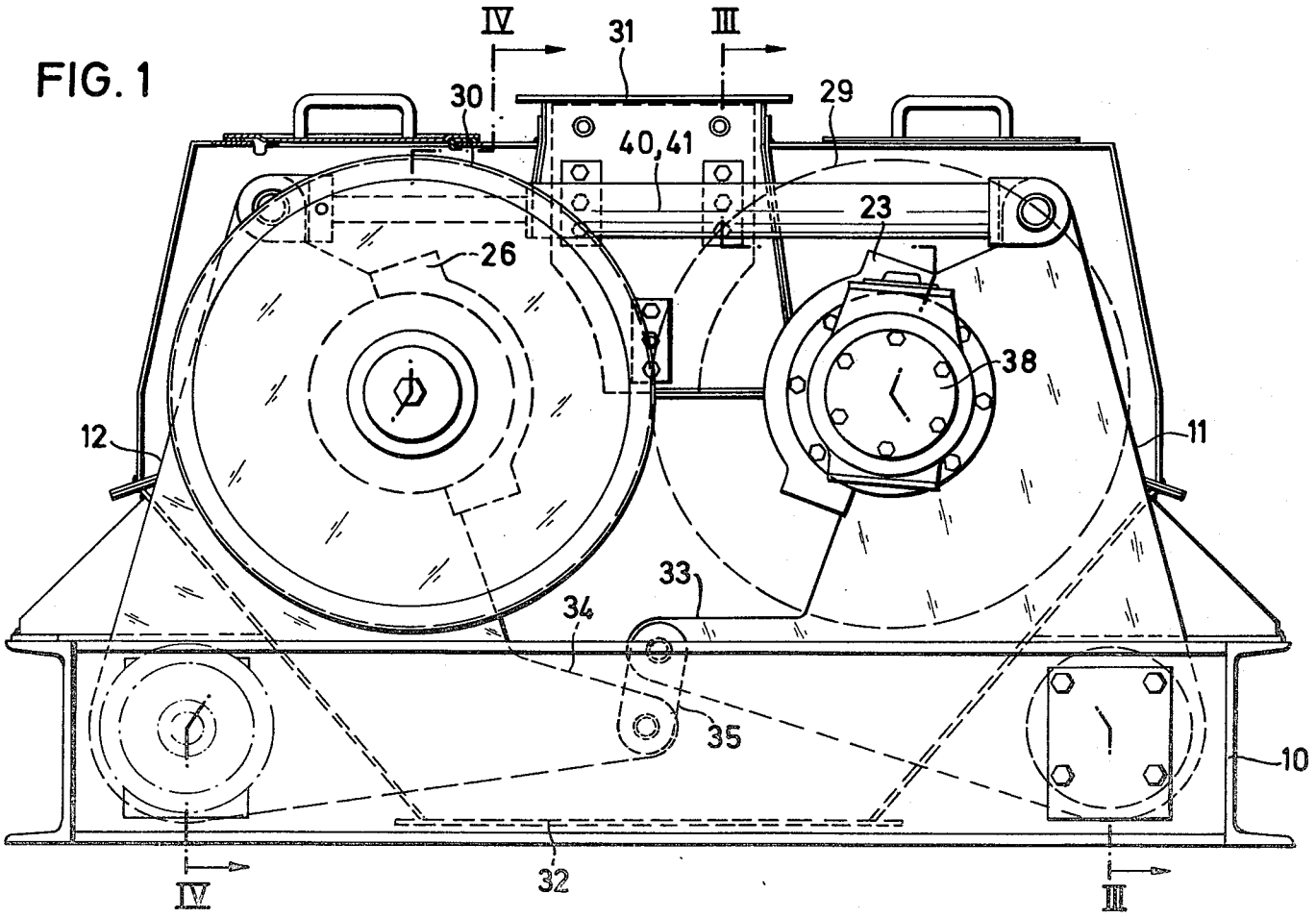
FIG. 1 shows in elevation a dual oscillating roll mill according to the invention.
Figure 2:
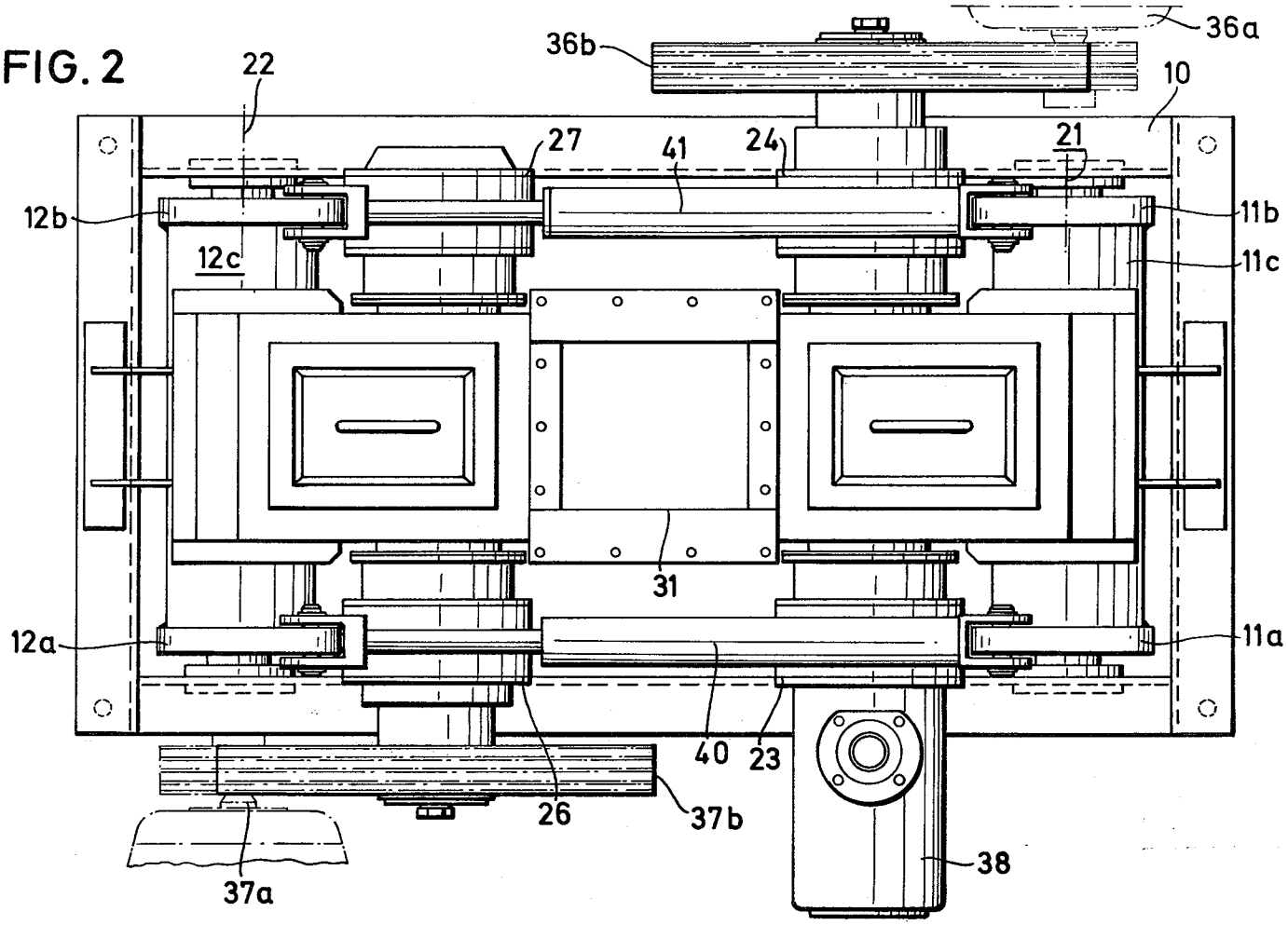
FIG. 2 shows the roll mill of FIG. 1 in plan view.

So that the two heavy rolls 29 and 30 cannot fall over to one side, the opposed carriages 11 and 12 have, as shown in FIG. 1, extensions 33 and 34 extending toward one another. A distal end portion of the extension 33 adjacently overlies a distal end portion of the extension 34, and substantially in line with a vertical plane projected through the crusher gap are articulatedly connected to one another by means of a link 35. Thus, the carriages are restrained to a mutual, synchronous and symmetrical swinging movement oppositely to the plane of symmetry through the crusher gap.

The roll 29 is driven through rotary drive 36*a* (FIG. 3) and belt pulley 36*b*, while the roll 30 is driven through rotary drive 37*a* (FIG. 4) and belt pulley 37*b*. The axes of rotation of the rotary drives lie in the axes of rotation 21 and 22 of the rotating shafts 11 and 12, so that the belt pulleys 36*b* and 37*b* may cooperate in a swinging movement of the rotating shafts, without thereby the belts undergoing an alteration in length. It would also be possible to drive only one of the two rolls, whereby the other roll then rotates by means of frictional contact with the material being ground.

A shifting apparatus 38 for the automatic continuous axial forced shifting reciprocation of the roll 29 is connected to the shaft 25, in order to attain uniform wear of the wear surface sleeves of both rolls over their entire width and to prevent any formation of grooves. In addition, the four bearing blocks 23, 24, 26, 27 in each instance permit being axially shifted by means of a clamping ring fastening 39.

The upper ends of the rocker arms 11*a* and 12*a* disposed opposite one another and the upper ends of the rocker arms 11*b* and 12*b* are in each instance connected with one another by means of a respective horizontally disposed hydraulic cylinder 40 or 41, which are pivotally attached at both ends. The two heavy rolls 29 and 30 are accordingly connected mutually by the hydraulic cylinders 40 and 41, whose length is so adjusted, that the desired crusher gap remains effective. In accordance with the invention, when an overload occurs, both rolls may deflect away from one another to the side, and in this connection there occur comparatively slight and fully symmetrical forces, which are not transmitted into the foundation or bedplate of the machine. The hydraulic cylinders 40,41 are, for example, prestressed with a pneumatic spring pressure of 100 atmospheres. The prestress force resulting therefrom is sufficiently greater than the operating force, which occurs when the normal crushing force in the crusher gap is held for example at 10 atmospheres.

The double oscillating roll mill according to the invention requires only comparative small and light bearings and shafts, as the force occurring even in case of overload, are comparatively small and fully symmetrical. All four bearings are similar to one another. As both rolls deflect to the side, the deflecting paths halve themselves as compared to a roll mill with only one deflectable roller. Thereby in the case of roll mills according to the present invention, there may be given to both deflectable rollers substantially higher circumferential speeds and accelerations. Therefore mills according to the present invention may have a substantially higher output yield compared with an ordinary roll mill, in which only one roll is deflectable.

I claim as my invention:

1. A roll type crushing mill having a base frame and a pair of rotatably mounted crushing rolls on parallel axes and in cooperative opposition to one another providing a material crushing nip therebetween, comprising:

a respective rocker carriage supporting each of said rolls on said frame, and each of said cariages comprising:

a pair of substantially coextensive upwardly extending spaced carriage members supporting on their upper portions bearings within which are rotatably received shaft means on the respective associated roll;

lower portions of said carriage members connected rigidly together by a tubular member;

said tubular member and the lower portions of said upright carriage members cooperatively supporting respective bearing means at the opposite ends of said tubular member;

respective coaxial, inwardly extending spaced stub shafts on said frame engaging in said bearing means and thereby pivotally mounting the load of the carriage and roll in each instance on a pivotal axis shich is substantially below the rotary axis of the associated roll;

said rolls being adapted to move apart as permitted by the carriage pivots to pass non-crushable matter between said nips;

means connecting adjacent lower portions of said carriages to compel equal opposite rocking of the carriages about the carriage pivots;

and means normally biasing said carriages toward one another to maintain the rolls in material crushing nip relation and adapted to effect an adjusted crushing gap at the roll nips and being yieldable to permit sufficient separation of the rolls to pass non-crushable matter between the roll nips.

2. A roll type crushing mill according to claim 1, wherein each of the upright carriage members of each of the carriages has an arm on its lower portion projecting toward the corresponding arm of the corresponding upright carriage member of the other of the carriages, the arms of the upright carriage members of one of the carriages extending into spaced overlying relation to the arms of the upright carriage members of the other carriage members, and respective links connecting the adjacent end portions of the corresponding arms of the carriages.

3. A roll type crushing mill according to claim 1, comprising rotary driving means for each of said rolls operating on a common axis with the associated carriage pivot axis, a driven pulley mounted coaxially on the shaft means of each of the rolls, and flexible transmission means connecting the driving means and the pulley in each instance, whereby each of the carriages is adapted to move pivotally while tension of the flexible transmission means remains constant.

4. A roll type crushing mill having a base frame and a pair of rotatably mounted crushing rolls on parallel axes and in cooperative opposition to one another providing a material crushing nip therebetween, comprising:

respective carriages pivotally mounted on said base frame;

each of said carriages supporting one of said rolls rotatably;

pivots of the carriages being related to the axes of rotation of said rolls in a manner to effect normal gravity bias of the rolls toward crushing nip cooperation;

yieldable biasing means for maintaining the rolls in biasing nip relationship and adapted for controlling the crushing nips of the rolls relative to one another in operation;

means for driving said rolls rotatably for crushing operation;

and means for controlling mutually synchronous and symmetrical rocking movements of said carriages relative to one another comprising projections on the carriages extending into cooperative relation to one another, and rocking movement control means comprising links connecting said projections in substantially a vertical plane extending between the nips of said rolls.

5. A roll type crushing mill according to claim 4, wherein each of said carriages has carriage members extending between said carriage pivots and rotary shaft means of the roll supported by the carriage in each instance, said projections extending toward one another cooperatively, and the projections on one of the carriages overlying the projections of the other of the carriages in spaced relation, and said links connecting end portions of the thus related projections.

6. A roll type crushing mill according to claim 4, comprising:

said means for rotatably driving said rolls comprising rotatable driving means coaxial with the pivotal axis of the carriage in each instance;

driven rotary means coaxial with shaft means of each respective roll;

and flexible transmission means operatively connecting said rotary driving means and said driven means for each of said rolls.

7. A roll type crushing mill according to claim 6, wherein said transmission means comprises a plurality of flexible belts.

* * * * *